US011597543B2

(12) United States Patent
Arbulu Ormaechea et al.

(10) Patent No.: US 11,597,543 B2
(45) Date of Patent: Mar. 7, 2023

(54) METHODS AND APPARATUS FOR PACKAGING PRODUCTS

(71) Applicant: ULMA Packaging, S. Coop., Oñati (ES)

(72) Inventors: Nerea Arbulu Ormaechea, Oñati (ES); Nicolas Arregi Arambarri, Oñati (ES); Eneko Izquierdo Ereño, Oñati (ES); Juan Jose Jauregui Balanzategui, Oñati (ES)

(73) Assignee: ULMA PACKAGING, S. COOP., Oñati (ES)

( * ) Notice: Subject to any disclaimer, the term of this patent is extended or adjusted under 35 U.S.C. 154(b) by 19 days.

(21) Appl. No.: 16/860,666

(22) Filed: Apr. 28, 2020

(65) Prior Publication Data

US 2020/0346794 A1 Nov. 5, 2020

(30) Foreign Application Priority Data

May 3, 2019 (EP) ..... 19382332

(51) Int. Cl.
*B65B 7/28* (2006.01)
*B65B 31/08* (2006.01)
(Continued)

(52) U.S. Cl.
CPC ..... *B65B 7/2878* (2013.01); *B65B 9/04* (2013.01); *B65B 31/028* (2013.01); *B65B 31/08* (2013.01);
(Continued)

(58) Field of Classification Search
CPC ..... B65B 7/164; B65B 7/2878; B65B 9/04; B65B 31/021; B65B 31/028; B65B 31/08;
(Continued)

(56) References Cited

U.S. PATENT DOCUMENTS 3,512,332 A * 5/1970 Klein ..... B65B 47/10 53/449
3,548,561 A * 12/1970 Young ..... B65B 11/52 53/433
(Continued)

FOREIGN PATENT DOCUMENTS

DE 4308684 A1 9/1994
DE 4327669 A1 2/1995
(Continued)

OTHER PUBLICATIONS

Extended European Search Report received in related application EP19382332.5, dated Sep. 30, 2019 (5 pages).
(Continued)

*Primary Examiner* — Stephen F. Gerrity
(74) *Attorney, Agent, or Firm* — Edell, Shapiro & Finnan, LLC

(57) ABSTRACT

Provided is a method and machine for packaging products, whereby a tray is generated by means of bonding a plastic film to a base film, the tray including a cavity of a given area and a rim surrounding the cavity. The cavity is generated by applying a given pressure on a forming area of the films. Before generating the tray and before pressing the base film, a support cut is generated in the forming area of the base film, such that with the subsequent pressure on the base film at least one gap is formed in the cavity of the tray as a result the support cut.

18 Claims, 4 Drawing Sheets

(51) Int. Cl.

| | |
|---|---|
| ***B65B 47/04*** | (2006.01) |
| ***B65B 31/02*** | (2006.01) |
| ***B65B 9/04*** | (2006.01) |
| ***B65B 47/00*** | (2006.01) |
| ***B65B 7/16*** | (2006.01) |
| ***B65B 61/02*** | (2006.01) |
| ***B65B 61/18*** | (2006.01) |

(52) U.S. Cl.
CPC ..... *B65B 47/00* (2013.01); *B65B 47/04* (2013.01); *B65B 7/164* (2013.01); *B65B 61/02* (2013.01); *B65B 61/18* (2013.01)

(58) Field of Classification Search
CPC ..... B65B 47/00; B65B 47/04; B65B 61/02; B65B 61/18; B31B 50/14; B31B 50/142; B31B 50/16; B31B 50/59; B31B 50/592; B31F 1/0077
USPC ..... 53/433, 453, 511, 559
See application file for complete search history.

(56) References Cited

U.S. PATENT DOCUMENTS

| | | | | | |
|---|---|---|---|---|---|
| 3,715,853 | A * | 2/1973 | Bemiss | B65B 1/02 | 53/433 |
| 4,056,221 | A | 11/1977 | Piltz et al. | | |
| 4,257,530 | A | 3/1981 | Faller | | |
| 4,533,065 | A * | 8/1985 | Chazal et al. | B29C 51/165 | 229/110 |
| 4,555,381 | A * | 11/1985 | Chazal et al. | B65D 5/56 | 156/224 |
| 4,685,274 | A * | 8/1987 | Garwood | B65B 31/021 | 53/433 |
| 4,779,758 | A * | 10/1988 | Chazal et al. | B65D 5/56 | 220/608 |
| 5,060,800 | A * | 10/1991 | Bodet et al. | B65D 85/72 | 493/110 |
| 5,076,436 | A * | 12/1991 | Bortolani et al. | B65B 11/52 | 53/433 |
| 5,253,801 | A | 10/1993 | Bernstein et al. | | |
| 2009/0152333 | A1* | 6/2009 | Maeaettae et al. | B65D 1/34 | 493/148 |
| 2014/0131428 | A1* | 5/2014 | Balke | B65B 7/164 | 493/93 |
| 2015/0217884 | A1 | 8/2015 | Zwaga et al. | | |
| 2019/0077573 | A1* | 3/2019 | Suokas | B65B 7/2878 | |
| 2020/0331684 | A1* | 10/2020 | Ghirardi et al. | B65B 7/2878 | |
| 2021/0069942 | A1* | 3/2021 | Larsson et al. | B31B 50/592 | |
| 2021/0086942 | A1* | 3/2021 | Enguix Nicolas et al. | B31B 50/44 | |
| 2022/0055789 | A1* | 2/2022 | Mero | B65B 7/2878 | |

FOREIGN PATENT DOCUMENTS

| | | | | | |
|---|---|---|---|---|---|
| DE | 19654230 | A1 | 7/1998 | | |
| DE | 102007047058 | A1 | 4/2008 | | |
| DE | 102009017993 | A1 | 11/2010 | | |
| EP | 0946391 | B1 | 6/2003 | | |
| EP | 3192641 | A1 | 7/2017 | | |
| FR | 2648792 | A1 * | 12/1990 | B65B 61/18 | |
| JP | 2000254985 | A | 9/2000 | | |
| WO | 9828195 | | 7/1998 | | |
| WO | 0130655 | A2 | 5/2001 | | |
| WO | 02085720 | A2 | 10/2002 | | |
| WO | WO-2011052507 | A1 * | 5/2011 | B65D 5/24 | |
| WO | 2018019448 | A1 | 2/2018 | | |
| WO | 2018109448 | A1 | 6/2018 | | |

OTHER PUBLICATIONS

Wikipedia, Modified atmosphere, https://en.wikipedia.org/w/index.php?title=Modified_atm . . . , Mar. 17, 2022, 7 pages.
Difference between Resin and Plastic, 2022 FacFox Docs, last modified Aug. 12, 2019, 6 pages.

* cited by examiner

METHODS AND APPARATUS FOR PACKAGING PRODUCTS

CROSS-REFERENCE TO RELATED APPLICATIONS

This application relates to and claims the benefit and priority to European Application No. EP19382332.5, filed May 3, 2019.

TECHNICAL FIELD

The present invention relates to methods and machines for packaging products, wherein packages formed by a tray covered by a lid film are generated. The tray is formed in turn by a base film giving the package the rigidity required and by a flexible plastic film adhered on said base film.

BACKGROUND

Packages for packaging products which comprise a base or tray and a lid film for covering the base, in which the base is formed in turn by a structure giving the package the rigidity required and by a flexible film adhered on said structure, are known. The structure can be formed by cardboard or a similar material, and the flexible film can be a monolayer or multilayer plastic film. Depending on the product to be packaged, as in the case of a number of food products, optimal preservation of said products is required and they are usually packaged in a modified atmosphere, i.e., a gas is introduced in the cavity of the package before closing it completely, or they are packaged in a vacuum or second skin.

Known packaging systems, specifically those in the food industry sector, comprise a structure normally manufactured with non-expanding materials adhered to a plastic film, among others. The use of cardboard or another material of plant or cellulose origin (paper or potato starch, for example) as the structure, given that it is a more environmentally friendly material and seeks to reduce the amount of plastic used, has recently come to be known.

EP0946391A1, for example, describes a packaging method in which a package with a tray formed by a structure or sheet of cardboard which is covered with a plastic film is used, and after arranging the product on said plastic film, the tray is covered with an additional film. The method starts with the already formed sheets of cardboard, which are supplied one by one in a row.

WO2018109448A1 describes a packaging method where the products are packaged in a package formed by a tray which is covered with a lid film. To generate the tray, it starts with a base film being coated with a plastic film, and said set being formed to give it the corresponding shape, with a cavity being generated as a result of said forming and the tray being obtained. The product to be packaged is arranged in said cavity, which is then covered with the lid film. The cavity of trays of this type is shallow due to the limitations of drawing or expansion of the base film, so they present at least the drawback of being conceived only for products suitable for being packaged in flat or shallow trays.

SUMMARY

Provided is a method and machine for packaging products.

One aspect of the invention relates to a method for packaging products. In the method, at least the following steps are performed for obtaining a package:

- a tray is generated by means of bonding a plastic film on a base film of a material of plant or cellulosic origin, the tray comprising a cavity of a given perimeter and area, and a rim surrounding the cavity, said cavity being generated by applying a given pressure on a forming area of said films,
- a product to be packaged is arranged in the cavity of the tray,
- a lid film is sealed to at least the rim of the tray, with the product arranged in the cavity, said tray being closed, and
- the set formed by the lid film and the tray is cut after said sealing, a package being obtained.

In the method, furthermore, before generating the tray and before pressing the base film, at least one support cut is generated in the forming area of the base film, such that the subsequent pressure that is applied on said forming area causes the separation of the regions of said base film which are on either side of the support cut, the base film having at least one gap in the cavity of the tray as a result of said separation. A package with a tray is thereby obtained in which the area of the cavity is larger than the forming area of the base film, and in which the bonding between the plastic film and the base film prevents the separate regions of the base film on either side of the support cut moving away from one another. As a result, the amount of base film in the cavity of said tray is less than the area of said cavity, and the bonding between both films generates a stable and rigid cavity.

A deeper package than the one described in WO2018109448A1 is thereby obtained without having to use a larger amount of base film and without needing to incorporate preformed trays like in the case of EP0946391A1, and the method can be implemented using films wound in the form of a reel in a feeder which can supply them continuously, thereby facilitating implementation of the method and increasing, or at least not negatively affecting productivity.

The method thus allows generating a deeper cavity in the base film, despite the low (or nil) drawability or expandability of the material of plant or cellulosic origin (at least compared with materials plastic). The described separation causes the presence of gaps in the base film after the forming thereof, but the bonding of the plastic film to said base film prevents the separate regions of the base film from moving away from one another once the tray is generated, such that said bonding provides stability to the tray, while at the same time said plastic film covers these gaps generated in the base film, the product being suitably packaged in the resulting package. Furthermore, by providing the base film with the rigidity required in the final package, properly bonded to the plastic film, the thickness of the plastic film can be smaller, where a monolayer plastic film can be used, for example, which allows using less plastic material with the economic savings and environmental advantages it entails.

The method furthermore allows savings in the material of the base film, as already described, since the rigidity required for the package is maintained despite the generated gaps. It is therefore not necessary for the entire surface of the cavity to be completed with material corresponding to said base film (the gaps do not have material), and that amount of material of the base film can be dispensed with but it will not negatively affect the size of the cavity of the package or the rigidity of said package.

Another aspect of the invention relates to a thermoforming machine. The machine is configured for generating a package comprising a tray and a lid film bonded to said tray and arranged on the tray, the tray being formed by bonding a plastic film on a base film of a material of plant or cellulosic origin. The tray comprises a cavity and a rim surrounding the cavity. The machine comprises a forming device configured for applying pressure on a forming area of the base film and of the plastic film for generating the cavity.

The machine further comprises a pre-cutting tool which is upstream of the forming device and configured for generating at least one support cut in the forming area of the base film, and the forming device is suitable, with the actuation thereof, for heating and pressing the plastic film against the base film, which causes the bonding between the base film and the plastic film, and causing the separation between the regions of said base film which are on either side of the support cut, the base film having at least one gap in the cavity of the tray as a result of said separation, such that the final package obtained comprises a tray in which the area of the cavity of the tray is larger than the forming area of the base film. The bonding between the base film and the plastic film prevents the separate regions of the base film on either side of the gap from moving away from one another once the tray is formed. The advantages discussed in relation to the method are also obtained with the machine.

These and other advantages and features of the invention will become apparent in view of the drawings and the detailed description of the invention.

DETAILED DESCRIPTION

Figure 1:
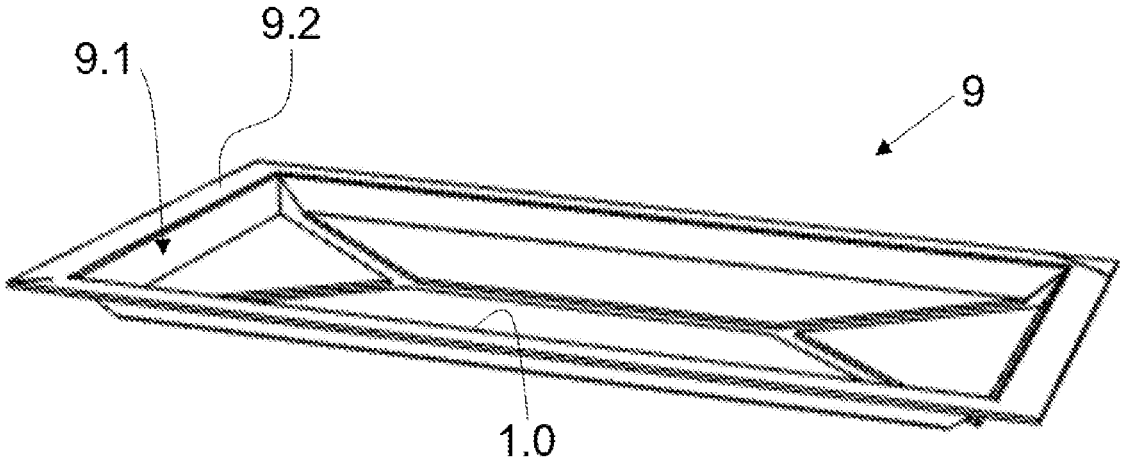
FIG. 1 shows a tray obtained from an embodiment of the method for packaging products according to the invention.
Figure 2:
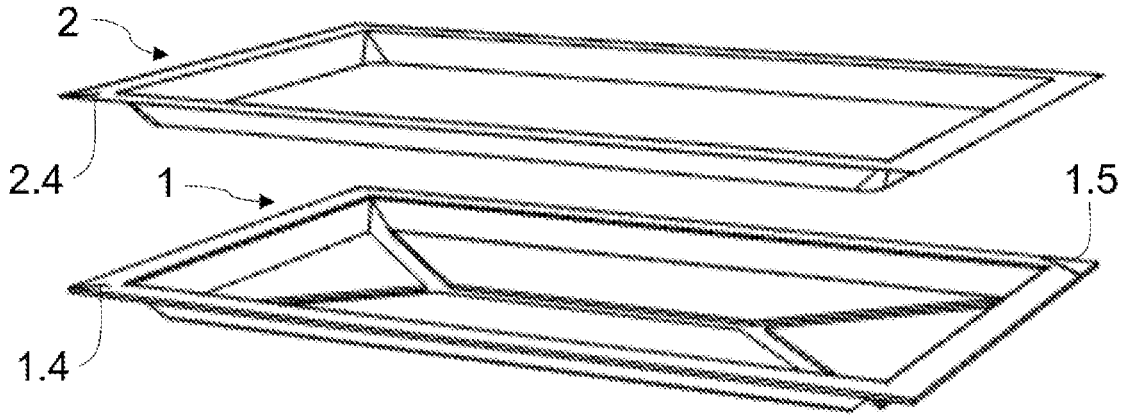
FIG. 2 shows an exploded view of the films which form the tray of FIG. 1.
Figure 3:
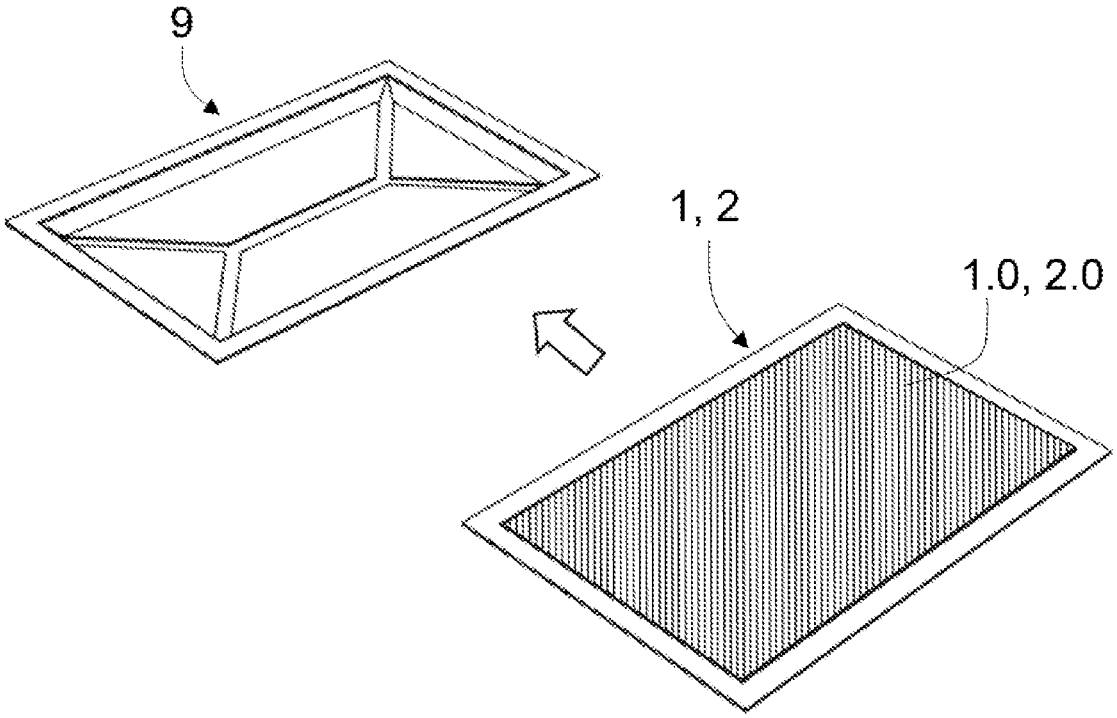
FIG. 3 shows the base and plastic films corresponding to a tray according to FIG. 1, before being formed and after being formed.

One aspect of the invention relates to a method for packaging products, whereby a tray 9 like the one shown by way of example in FIG. 1 is generated by means of bonding a plastic film 2 on a base film 1 of a material of plant or cellulosic origin (see FIG. 2), such as cardboard, paper, or potato starch, for example. The tray 9 comprises a cavity 9.1 of a given perimeter and area, and a rim 9.2 surrounding the cavity 9.1, and said cavity 9.1 is generated by applying a given pressure on a forming area 1.0 and 2.0 of said films 1 and 2. FIG. 3 shows the overlapping films 1 and 2 corresponding to a tray 9 according to FIGS. 1 and 2, before being formed and after being formed resulting in said tray 9.

Preferably, the base film 1 and the plastic film 2 are supplied continuously in a direction of forward movement A. The supply is furthermore carried out such that the plastic film 2 is arranged on the base film 1. Preferably, each of said films 1 and 2 is wound in the form of a reel 1B and 2B in a respective feeder, which feeders are not depicted in the drawings, of a packaging machine 100 like the one schematically shown by way of example in FIG. 4, and said films 1 and 2 are supplied from said feeders.

In the context of the invention, when "downstream" and "upstream" are used they are to be considered with respect to the direction of forward movement A.

Once the plastic film 2 is arranged on the base film 1, preferably at least the forming area 2.0 of the plastic film 2 is heated directly and pressure is exerted on the forming areas 1.0 and 2.0 of both films 1 and 2 jointly and simultaneously, when both films 1 and 2 are located one on top of the other, which involves a single step for forming and for bonding both films 1 and 2 as a consequence of the pressure exerted on both films 1 and 2 and the heating of at least the forming area 2.0 of the plastic film 2. The tray 9 is obtained as a result of the forming and bonding. Alternatively, both films 1 and 2 can be pressed independently for causing the forming thereof in an independent manner, being arranged one on top of the other once formed for bonding them to one another in a subsequent step, or alternatively both films 1 and 2 can be bonded to one another in a prior step (by heat, for example), and after said bonding, the joint forming thereof in a subsequent step can be caused.

With the tray 9 generated, a product to be packaged (not depicted) is arranged in the cavity 9.1 of the tray 9 and a lid film 3 is sealed to at least the rim 9.2 of the tray 9, said tray 9 being closed and said product being packaged. Finally, the set formed by the lid film 3 and the tray 9 is cut after said sealing, with an independent package E like the one shown by way of example in FIGS. 5A and 5B (without product) being obtained.

Figure 5A:
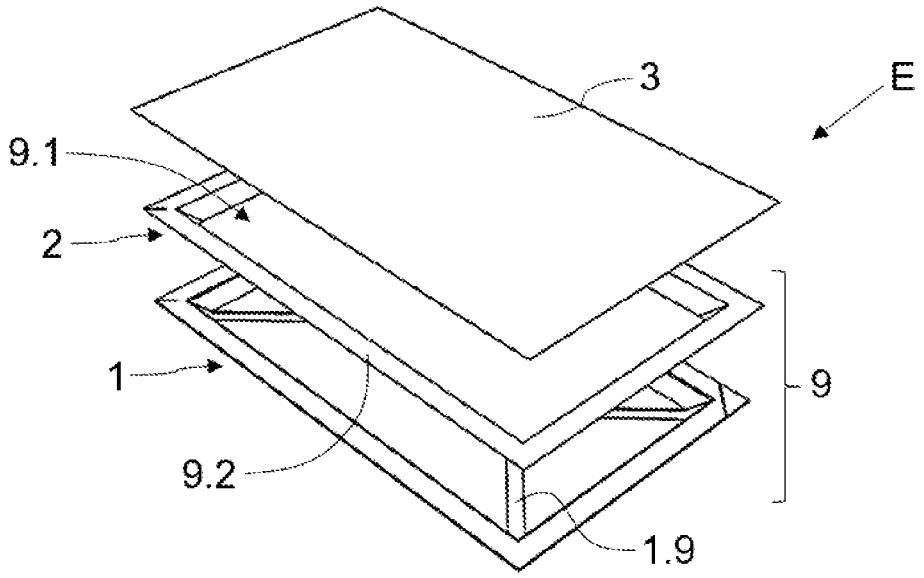
FIG. 5A shows a perspective view of a package obtained with an embodiment of the method according to the invention, without product, and with the films forming it shown in an exploded view.
Figure 5B:
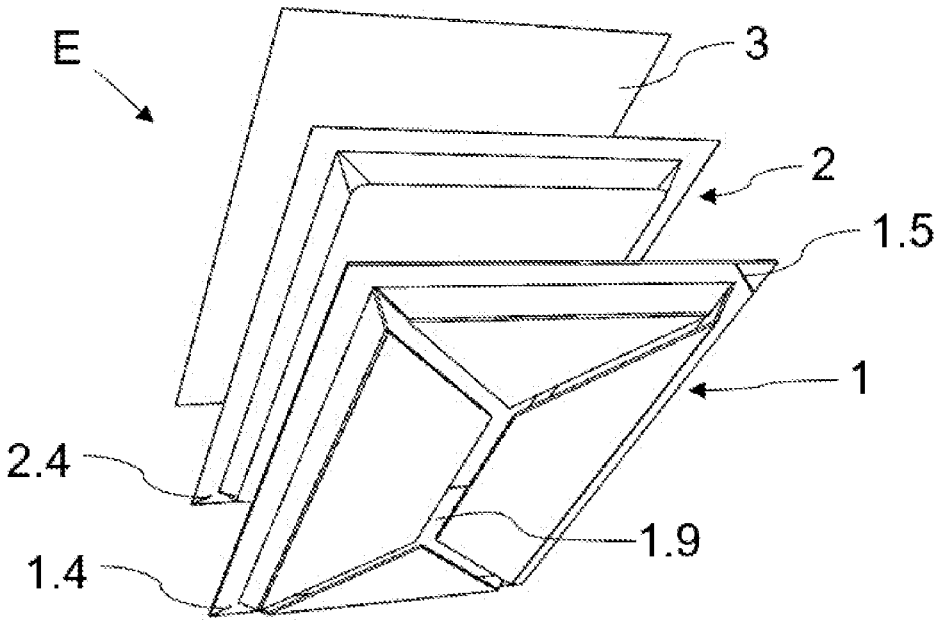
FIG. 5B shows a bottom perspective view of the package of FIG. 5A.
Figure 6:
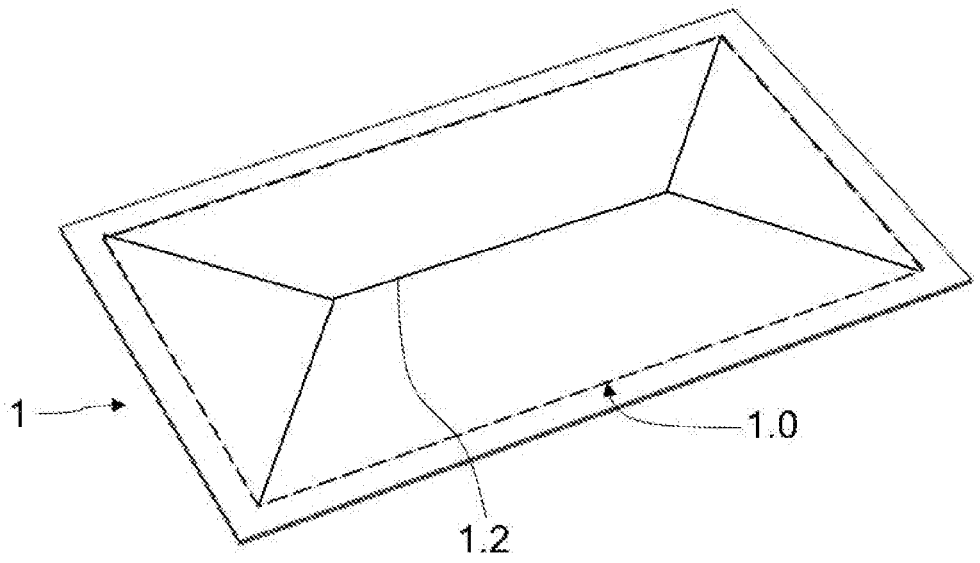
FIG. 6 shows a support cut in a base film for a tray like that of FIG. 1.

Furthermore, in any of the embodiments of the method, before pressing the base film 1 at least one support cut 1.2 is generated in the forming area 1.0 of said base film 1, as shown in FIG. 6 by way of example, such that the pressure which is subsequently applied on said forming area 1.0 causes the separation of the regions of said base film 1 which are on either side of the support cut 1.2, the base film 1 having at least one gap 1.9 in the cavity 9.1 of the tray 9 as a result of said separation. A package E with a tray 9 is thereby obtained in which the area of the cavity 9.1 of the tray 9 is larger than the forming area 1.0 of the base film 1, and the bonding between the plastic film 2 and the base film 1 prevents the separate regions of the base film 1 on either side of the support cut 1.2 from moving away from one another once the tray 9 is generated. As a result, the amount of base film 1 in the cavity 9.1 of said tray 9 is less than the area of said cavity 9.1 and the bonding between both films generates a stable and rigid cavity as a result of the properties of both films 1 and 2 bonded to one another. The package E shown in FIGS. 5A and 5B has been obtained with a support cut 1.2 like the one shown in FIG. 6.

In the context of the invention, "support cut" must be interpreted to mean that action on the base film 1 which entails a through cut in the base film 1, or a partial cut in the thickness of said base film 1, which generates a weakening in the base film 1 without said partial cut entailing a complete cut in said base film 1, such that the subsequent pressure ends up cutting the entire thickness and the corresponding gap 1.9 is generated.

The support cut 1.2 of the base film 1 is made such that it does not demarcate a closed contour in the forming area 1.0 of said base film 1. This thereby prevents part of the base film 1 from detaching from the rest and falling off, which would be negative when implementing the method in a packaging machine 100. The support cut 1.2 can have different shapes and/or configurations, depending on the requirements or intentions for the package E, and even a plurality of support cuts 1.2 could be made. FIGS. 5A and 5B show the package E, with the films 1, 2, and 3 forming it in an exploded view, with a given shape of the support cut 1.2, and in FIG. 7 another package E is shown, with the films 1, 2, and 3 forming it in an exploded view, with another given shape of the support cut 1.2.

FIGS. 5A and 5B show a package E generated from a support cut 1.2 comprising a "Y" shape joined to an inverted "Y" shape, as shown in FIG. 6, comprising the gap 1.9 resulting also said shape. The support cut 1.2 can have another configuration, such as an "X" shape or another shape.

Figure 7:
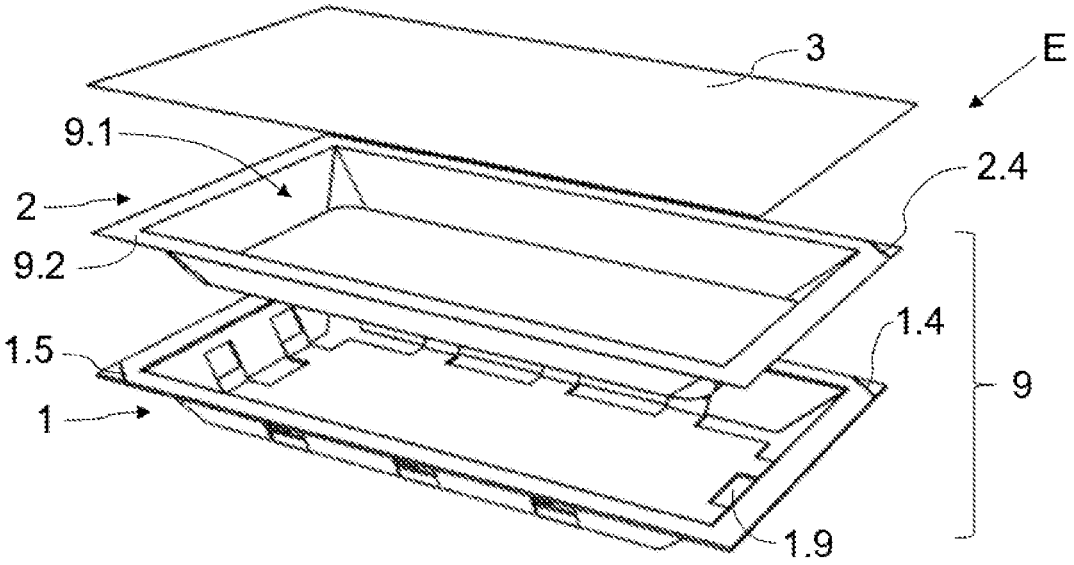
FIG. 7 shows a perspective view of a package obtained with another embodiment of the method according to the invention, without product, and with the films forming it shown in an exploded view.

FIG. 7 shows a package E generated from a support cut 1.2 which defines a contour with at least one bonding point or region (not depicted in the drawings), such that as a result of said bonding point a closed contour is not demarcated. When pressure is applied on the base film 1, as a result said bonding point is caused to break and the gap 1.9 shown in said FIG. 7 is generated. Generally, the bonding point or region is used in those configurations in which, after the forming of the base film 1, a part of said base film 1 can be obtained physically separated from the rest of the base film 1, and said bonding point or region prevents said separation from occurring ahead of time. However, due to the material used in the base film 1 other configurations of the support cut 1.2 may require a bonding point or region, because if the material is ductile and/or the thickness of the base film 1 is very small, the end of the base film 1 closest to the support cut 1.2 may tend to drop, opening up an unwanted space between the regions on either side of said support cut 1.2 before applying pressure on the forming area 1.0 of the base film 1. A configuration of the support cut 1.2 that could give rise to said situation corresponds with the that shown in FIG. 6, for example.

In some embodiments of the method, the generated packages E are easy-open packages. In these cases, before arranging the lid film 3 on the tray 9 an easy-open cut 1.4 is made in the base film 1 and an easy-open cut 2.4 is made in the plastic film 2, coinciding with said easy-open cut 1.4 of the base film 1 (they are preferably performed jointly and simultaneously), in a region of said base film 1 and of said plastic film 2 which is part of the rim 9.2 of the tray 9, resulting in an opening region between said cuts 1.4 and 2.4 and the edge of the generated final package E. Said regions of the films 1 and 2 are bonded to the lid film 3 when said lid film 3 is bonded to the tray 9. Thus, by acting on said opening region can be readily detached or separated the lid film 3 of the tray 9, opening the package E in a simple manner and thus being able to access the product packaged therein.

The tray 9 of the package E is formed by two films 1 and 2, and to facilitate the subsequent separation of said films 1 and 2 and their recycling, in some embodiments of the method, before arranging the plastic film 2 on the base film 1 a separating cut 1.5 is made in a region of the base film 1 which subsequently forms part of the rim 9.2 of the tray 9. The separating cut 1.5 is thus arranged in the rim 9.2 of the tray 9, so by acting on a separating region of the rim 9.2 that is located between said separating cut 1.5 and the edge of the tray 9, once the third film 3 of the package E has been removed, the two films 1 and 2 can be readily separated. Said region of the base film 1 is bonded to the plastic film 2 as a result of the bonding between said base film 1 and said plastic film 2, such that it does not become detached.

In some embodiments, the method is furthermore configured for packaging products in a second skin and/or modified atmosphere. In these cases, before arranging the plastic film 2 on the base film 1 for generating the corresponding tray 9, at least one hole, not depicted in the drawings, is made in a region of the plastic film 2 which will coincide with at least one of the cuts 1.2, 1.4, and 1.5 made, or being made, in the base film 1 when said plastic film 2 is arranged on the base film 1, and/or with the gap 1.9 of the base film 1 present in the tray 9 once said tray 9 is generated. Subsequently, and through said hole, after arranging the lid film 3 on the tray 9 and before bonding said lid film 3 to said tray 9, a vacuum is generated on the space demarcated between said lid film 3 and said tray 9 for the case of second skin packaging, and/or a gas suitable for packaging products in a modified atmosphere is introduced in said space for the case of modified atmosphere packaging. Said hole is closed with the lid film 3 as a result of the subsequent bonding between said lid film 3 and the tray 9.

In the case of second skin packaging, preferably, the hole of the plastic film 2 is made before arranging the plastic film 2 on the base film 1, such that it coincides with the gap 1.9 of the base film 1 present in the tray 9 once said tray 9 is generated and is not located below the product which is arranged in said tray 9, such that the vacuum is applied on a region close to said product and a more effective second skin packaging is obtained. Second skin packaging is known to require the heating the lid film 3, such that as a consequence of said heating and the vacuum generated in the space demarcated between said lid film 3 and said tray 9, the lid film 3 is bonded to the plastic film 2 on the entire surface of the package E not occupied by the product, said hole thus being covered and a tight package E being generated. Making the hole of the plastic film 2 such that it coincides with the gap 1.9 of the base film 1 before arranging the plastic film 2 on the base film 1 minimizes the amount of plastic film 2 required in the packaging method, as it prevents generating said holes in regions outside the package E that will subsequently be disposed of, and it also increases production speed as the vacuum is applied directly on the cavity 9.1 of the tray 9.

In the case of modified atmosphere packaging, the hole of the plastic film 2 is preferably made in a region of said plastic film 2 which will form part of the rim 9.2 of the corresponding tray 9. In this case, it is not necessary to place the hole as close to the product as in the case of second skin packaging to achieve a more effective packaging. Modified atmosphere packaging is known to require introducing a gas suitable for packaging products in the package E. Preferably, the hole of the plastic film 2 corresponds with the easy-open cut 1.4 and 2.4 made in the base film 1 and in the plastic film 2 which is arranged in the rim 9.2 of the package E, such that the gas is introduced in the cavity 9.1 of the tray 9 through said hole (the easy-open cut 1.4 and 2.4) and an additional hole does not have to be made. When the lid film 3 is bonded to the plastic film 2 along the rim 9.2, said hole is hermetically sealed. The amount of plastic film 2 required in the packaging method is thus minimized, as it prevents generating said holes in regions outside package E which must subsequently be disposed of, and in the preferred case an additional functionality is obtained for the easy-open cut 1.4 and 2.4.

In some embodiments of the method, said method is configured for arranging at least one label, not depicted in the drawings, with information relating to the product to be packaged or packaged on the gap 1.9 of the base film 1 of the tray 9 (the label can logically furthermore surpass said gap 1.9, depending on it size). Said label is arranged in the base film 1 such that at least separate regions of said base film 1 are separated by the gap 9.1, such that said label also helps to prevent the separation of regions of the base film 1 on either side of the support cut 1.2 from moving away from one another and allows even further reducing the amount (thickness) of the base film 1 and/or plastic film 2 used in the package E. The label can be made of a material of a plant or cellulosic origin which bears print and is adhered to the tray 9 through a conventional labeling machine, for example.

In some embodiments, the package E comprises a lower film of plastic material (not depicted in the drawings), preferably of the same plastic material as the plastic film 2, bonded to the base film 1 on the side opposite that of the plastic film 2. The bonding between the lower film and the base film 1 is carried out simultaneously to the bonding between the base film 1 and the plastic film 2. To that end, the lower film is supplied from a feeder not depicted in the drawings, where said lower film is wound in the form of a reel, such that it is arranged below the base film 1 after making the support cut 1.2 in the base film 1, and said lower film is bonded to the lower face of the base film 1 on either side of the support cut 1.2, at least two regions of the base film 1 separated from one another bonding to one another in a manner equivalent to the plastic film 2 but on the opposite face of the base film 1, the outer and inner contour of the base film 1 thus covering the plastic film 2 and the lower film and the bonding between the plastic film 2 and the lower film to the base film 1 assuring to a greater extent that the separate regions of the base film 1 on either side of the support cut 1.2 do not separate from one another. A more rigid package E is thereby generated, and the material of the base film 1 and the plastic film 2 can thus be reduced.

Once the package E is generated, by means of a corresponding cutting tool 104 a final cut is made for separating said package E from the rest of the films 1, 2, and 3 and for thus obtaining an individual package E. The packages E can be generated in individual rows, in parallel rows. In this latter case, the cutting tool preferably comprises a first cutting tool 104.1 for making the transverse cut and a second cutting tool 104.2 for making the longitudinal cut.

Figure 4:
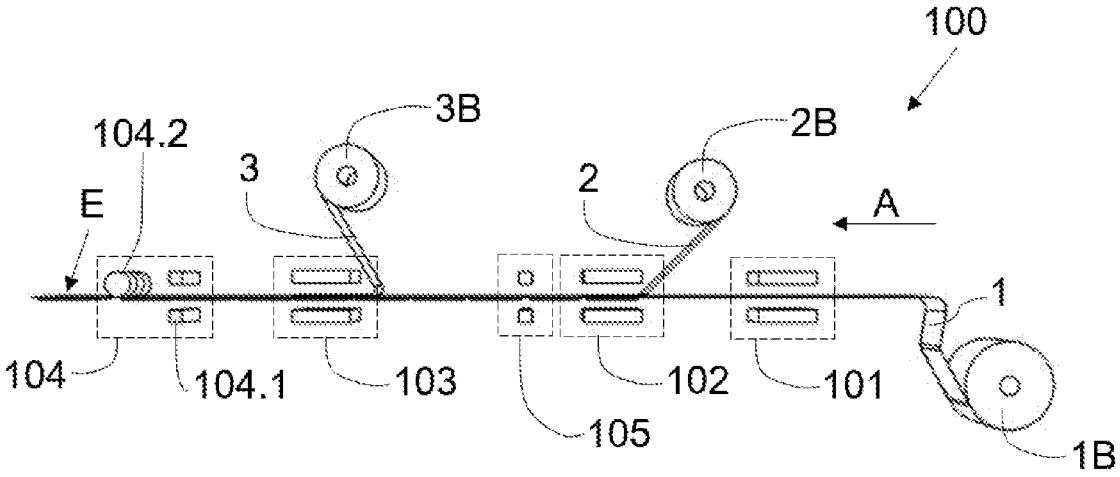
FIG. 4 schematically shows an embodiment of a thermoforming machine according to the invention.

Another aspect of the invention relates to a thermoforming machine 100 suitable for packaging products like the one shown schematically and by way of example in FIG. 4.

The machine 100 is configured for generating packages E comprising a tray 9 which defines a cavity 9.1 where the product to be packaged is arranged (or the packaged product is arranged) and a lid film 3 bonded to said tray 9, which is arranged on the tray 9 and covers the cavity 9.1 (and the product arranged in the cavity 9.1). The tray 9 is formed by bonding a plastic film 2 on a base film 1 of material of plant or cellulosic origin, such as cardboard, paper, or potato starch, for example, and comprises a rim 9.2 surrounding the cavity 9.1. The tray 9 can be like the one discussed above for the method of the invention, in any of its configurations.

Preferably, in the machine 100 the base film 1 and the plastic film 2 are supplied continuously in the direction of forward movement A, as described above for the method. The supply is furthermore carried out such that the plastic film 2 is arranged on the base film 1. Preferably, each of said films 1 and 2 is wound in the form of a reel 1B and 2B in a respective feeder, and said films 1 and 2 are supplied from said feeders.

Preferably, the lid film 3 is supplied continuously in the direction of forward movement A, and said lid film 3 is wound in the form of a reel 3B in a feeder not depicted in the drawings. The feeder is arranged upstream of the sealing station 103, and preferably downstream of the feeders of the films 1 and 2, and even downstream of the forming device 102. With the tray 9 generated, a product to be packaged (not depicted) is arranged in the cavity 9.1 of the tray 9 and the lid film 3 is sealed to at least the rim 9.2 of the tray 9 in a sealing station 103 with a sealing tool, said tray 9 being closed. Finally, the set formed by the lid film 3 and the tray 9 is cut after said sealing with the cutting tool 104, an independent package E like the one shown by way of example in FIGS. 5A and 5B (without product) being obtained.

The machine 100 comprises a forming device 102, which is configured for applying the pressure on the respective forming area 1.0 and 2.0 of said films 1 and 2 for generating the cavity 9.1. Preferably, the forming device 102 comprises a single forming tool 102 for simultaneously pressing both films 1 and 2 (when they are overlapping), in which case it would be arranged downstream of the feeders of the films 1 and 2, but it could comprise a respective forming tool for pressing on each of the films 1 and 2, for example. In this latter case, the forming device 102 may comprise a respective forming tool for each film 1 and 2, and each forming tool would be downstream of the feeder of the corresponding film 1 and 2.

The machine 100 further comprises a pre-cutting tool 101 which is arranged upstream of the forming device 102 and downstream of the feeder of the base film 1. The feeder of the plastic film 2 can be arranged downstream of said pre-cutting tool 101. The pre-cutting tool 101 is configured for generating the support cut 1.2 (or support cuts 1.2) in the forming area 1.0 of the base film 1, which has already been discussed for the method. Preferably, the forming device 102 is suitable, with the actuation thereof, for heating and pressing the second film 2 against the base film 1, which causes the bonding between the base film 1 and the second film 2, while at the same time it causes the separation of the regions of the base film 1 which are on either side of the support cut 1.2 upon generating the cavity 9.1, the base film 1 having at least one gap 1.9 in the cavity 9.1 of the tray 9 as a result of said separation. The obtained final package E thereby comprises a tray 9 in which the area of the cavity 9.1 of the tray 9 is larger than the forming area 1.0 of the base film 1.

The pre-cutting tool 101 comprises a cutting edge (not depicted in the drawings) for making the support cut 1.2 in the base film 1, and said cutting edge is configured so as to not demarcate a closed contour. There is therefore no risk of part of the base film 1 becoming detached, which could be dangerous for the machine 100 and furthermore a package E would not be generated. That described above for the method in relation to the bonding point or region would also be valid for the case of the machine 100 of the invention and is not going to be repeated.

Some embodiments of the machine 100 are configured for generating an easy-open package E, like the one described for the method. In these embodiments, the machine 100 comprises an easy-open piercing tool 105 configured for making the easy-open cuts 1.4 and 2.4 in both films 1 and 2, in one and the same region of said base film 1 and of said plastic film 2 which is part of the rim 9.2 of the tray 9, resulting in an opening region between said cuts 1.4 and 2.4 and the edge of the generated final package E, as described above.

In some embodiments, the machine 100 comprises a separating piercing tool configured for making the separating cut 1.5 in a region of the base film 1 which subsequently forms part of the rim 9.2 of the tray 9, resulting in a separating region in said rim 9.2 between said separating cut and the edge of the tray 9 like the one described above. In the embodiments in which the machine 100 comprises an easy-open piercing tool 105 and a separating piercing tool, both tools can be the same tool with the implements and/or cutting edges required for carrying out the corresponding operations.

In some embodiments, the machine 100 comprises a piercing tool not depicted in the drawings, which is arranged upstream of the forming station 102 and is configured for making a hole in a region of the plastic film 2, said hole coinciding with at least one of the cuts 1.2, 1.4, and 1.5 made in the base film 1 and/or with the gap 1.9 of the base film 1 present in the tray 9, as described above for the method. In these embodiments, the machine 100 further comprises a device not depicted in the drawings, preferably in the sealing station 103, which is configured for generating a vacuum between the lid film 3 and said tray 9 and/or for introducing a gas suitable for packaging products in a modified atmosphere between the lid film 3 and said tray 9 through said hole, as described above for the method. The piercing tool is configured for making the hole of the plastic film 2 in a region of said plastic film 2 which is part of the rim 9.2 of the corresponding tray 9 or for making the hole of the plastic film 2 such that it coincides with the gap 1.9 of the base film 1 present in the tray 9. In some embodiments, said piercing tool is the easy-open piercing tool 105, said easy-open piercing tool 105 being configured for carrying out both operations.

In some embodiments, the machine 100 comprises a feeder (not depicted in the drawings) suitable for feeding a lower film of plastic material wound in the form of a reel (not depicted). The feeder arranges said lower film of plastic material under the base film 1. The bonding between the lower film and the base film 1 is carried out simultaneously to the bonding between the base film 1 and the plastic film 2 in the forming device 102. To that end, the lower film is supplied such that it is arranged under the base film 1 once the pre-cutting tool 101 makes the support cut 1.2 in the base film 1, and said lower film is bonded to the lower face of the base film 1 on either side of the support cut 1.2 in the forming device 102, at least two regions of the base film 1 separated from one another bonding to one another in a manner equivalent to the plastic film 2 but on the lower side of the base film 1, the outer and inner contour of the base film 1 thus covering the plastic film 2 and the lower film, and the bonding between the plastic film 2 and the lower film to the base film 1 assuring to a greater extent that the separate regions of the base film 1 on either side of the support cut 1.2 do not separate from one another.

The machine 100 is configured to enable carrying out the method of the invention according to any of its embodiments and/or configurations, comprising to that end the corresponding configuration and/or embodiment, and vice versa. Both the machine and the method of the invention are configured for generating packages like those discussed, in any of their embodiments and/or configurations, comprising to that end the corresponding configuration and/or embodiment.

The following clauses provide additional combinations of elements.

Clause 1: Method for packaging products, wherein a tray (9) is generated by means of bonding a plastic film (2) on a base film (1) of a material of plant or cellulosic origin, the tray (9) comprising a cavity (9.1) of a given perimeter and area and a rim (9.2) surrounding the cavity (9.1), and said cavity (9.1) being generated by applying a given pressure on a forming area (1.0, 2.0) of said films (1, 2), a product to be packaged is arranged in the cavity (9.1) of the tray (9), a lid film (3) is sealed to at least the rim (9.2) of the tray (9), with the product arranged in the cavity (9.1), said tray (9) being thus closed, and the set formed by the lid film (3) and the tray (9) is cut after said sealing, a package (E) being obtained, before generating the tray (9) and before pressing the base film (1), at least one support cut (1.2) is generated in the forming area (1.0) of the base film (1), such that the subsequent pressure that is applied on said forming area (1.0) causes the separation of the regions of said base film (1) which are on either side of the support cut (1.2), the base film (1) having at least one gap (1.9) in the cavity (9.1) of the tray (9) as a result of said separation, such that a package (E) with a tray (9) in which the area of the cavity (9.1) of the tray (9) is larger than the forming area (1.0) of the base film (1) is obtained.

Clause 2: Method according to clause 1, wherein the support cut (1.2) made in the base film (1) is performed such that it does not demarcate a closed contour in the forming area (1.0) of said base film (1).

Clause 3: Method according to clause 1 or 2, wherein the support cut (1.2) made in the base film (1) comprises an "X" shape or a "Y" shape joined to an inverted "Y".

Clause 4: Method according to any of clauses 1 to 3, wherein the support cut (1.2) made in the base film (1) comprises at least one bonding point, or bonding region, which demarcates an unclosed contour, such that when pressure is applied on the forming area (1.0) of the base film (1), the bonding point is caused to break and the corresponding gap (1.9) is generated.

Clause 5: Method according to any of clauses 1 to 4, wherein before arranging the lid film (3) on the tray (9), an easy-open cut (1.4) is made in the base film (1) and an easy-open cut (2.4) is made in the plastic film (2), coinciding with said easy-open cut (1.4) of the base film (1), in a region of said base film (1) and of said plastic film (2) which form part of the rim (9.2) of the tray (9), resulting in an opening region between said cuts and the edge of the final package (E) generated.

Clause 6: Method according to any of clauses 1 to 5, wherein before arranging the plastic film (2) on the base film (1) a separating cut (1.5) is made in a region of the base film (1) which subsequently forms part of the rim (9.2) of the tray (9), resulting in a separating region in said rim (9.2) between said separating cut and the edge of the tray (9).

Clause 7: Method according to any of clauses 1 to 6, wherein, before arranging the plastic film (2) on the base film (1) for generating the corresponding tray (9), at least one hole is made in a region of the plastic film (2) which coincides with at least one of the cuts (1.2, 1.4, 1.5) made in the base film (1) and/or the gap (1.9) of the base film (1) present in the tray (9), and, after arranging the lid film (3) on the tray (9) and before bonding said lid film (3) to said tray (9), a vacuum is generated between said lid film (3) and said tray (9) through said hole and/or a gas suitable for packaging products in a modified atmosphere is introduced in said space through said hole, and said hole is then closed with the lid film (3) when said lid film (3) is bonded to said tray (9).

Clause 8: Method according to clause 7, wherein the hole of the plastic film (2) is performed in a region of said plastic film (2) which is part of the rim (9.2) of the corresponding tray (9).

Clause 9: Method according to clause 7, wherein the hole of the plastic film (2) is made before arranging the plastic film (2) on the base film (1), such that it coincides with the gap (1.9) of the base film (1) present in the tray (9) once said tray (9) is generated.

Clause 10: Thermoforming machine for packaging products, the machine (100) being configured for generating a package (E) comprising a tray (9) and a lid film (3) bonded to said tray (9) and arranged on the tray (9), the tray (9) being formed by the bonding between a base film (1) of a material of plant or cellulosic origin and a plastic film (2) arranged on the base film (1), and said tray (9) comprising a cavity (9.1) and a rim (9.2) surrounding the cavity (9.1), the machine (100) comprising a forming device (102) configured for applying pressure on a forming area (1.0, 2.0) of the base film (1) and of the plastic film (2) for generating the cavity (9.1), the machine (100) further comprises a pre-cutting tool (101) which is configured for generating at least one support cut (1.2) in the forming area (1.0) of the base film (1), the forming device (102) being suitable, with the actuation thereof, for heating and pressing the second film (2) against the base film (1), which causes the bonding between the base film (1) and the second film (2), and causing the separation of the regions of the base film (1) which are on either side of the support cut (1.2) upon generating the cavity (9.1), the base film (1) having at least one gap (1.9) in the cavity (9.1) of the tray (9) as a result of said separation, such that the final package (E) obtained comprises a tray (9) in which the area of the cavity (9.1) of the tray (9) is larger than the forming area (1.0) of the base film (1).

Clause 11: Machine according to clause 10, wherein the pre-cutting tool (101) comprises a cutting edge for making the support cut (1.2) in the base film (1), and said cutting edge is configured so as to not demarcate a closed contour.

Clause 12: Machine according to clause 10 or 11, comprising an easy-open piercing tool (105) configured for making an easy-open cut (1.4) in the base film (1) and an easy-open cut in the plastic film (2), in one and the same region of said base film (1) and of said plastic film (2) which is part of the rim (9.2) of the tray (9), resulting in an opening region between said cuts and the edge of the final package (E) generated.

Clause 13: Machine according to any of clauses 10 to 12, comprising a separating piercing tool configured for making a separating cut (1.5) in a region of the base film (1) which subsequently forms part of the rim (9.2) of the tray (9), resulting in a separating region in said rim (9.2) between said separating cut and the edge of the tray (9).

Clause 14: Machine according to any of clauses 10 to 13, comprising a piercing tool configured for making a hole in a region of the plastic film (2) which coincides with at least one of the cuts (1.2, 1.4, 1.5) made in the base film (1) and/or with the gap (1.9) of the base film (1) present in the tray (9), a device configured for generating a vacuum between the lid film (3) and said tray (9) and/or for introducing a gas suitable for packaging products in a modified atmosphere between the lid film (3) and said tray (9) through said hole.

Clause 15: Machine according to clause 14, wherein the piercing tool is arranged upstream of the forming device (102) and is configured for making the hole of the plastic film (2) such that it coincides with the gap (1.9) of the base film (1) present in the tray (9) once the tray (9) is generated.

What is claimed is:

1. A method for packaging products comprising:

producing a tray, the method of producing the tray comprising:

producing a support cut in a forming area of a base film, the base film being a material of a plant or a cellulosic origin;

obtaining a plastic film having a forming area;

simultaneously applying heat and pressure to the forming area of each of the base film and plastic film to simultaneously bond the plastic film to the base film while at the same time causing a separation of first and second regions of the base film on opposite sides of the support cut such that a gap exists between the first and second regions;

the bonding of the plastic film to the base film forming a cavity and a rim surrounding the cavity, the formation of the gap in the base film resulting in the cavity having a first surface area greater than the forming area of the base film.

2. The method for packaging products according to claim 1, further comprising applying a lid film over the cavity and sealing the lid film to the rim.

3. The method for packaging a product according to claim 2, wherein before sealing the lid film to the rim, an easy-open cut is made in the base film and an easy-open cut is made in the plastic film, coinciding with the easy-open cut of the base film, the easy-open cut of the base film and the easy open cut of the plastic film being respectively made in a region of the base film and a region of the plastic film which form part of the rim.

4. The method for packaging a product according to claim 2, wherein before bonding the plastic film on the base film, producing a hole in a region of the plastic film which coincides with the support cut produced in the base film, after applying the lid film over the cavity and before sealing the lid film to the rim, introducing a modified atmosphere into the tray cavity through the hole, the hole being closed when the lid film is sealed to the rim.

5. The method for packaging a product according to claim 4, wherein the hole of the plastic film coincides with the gap of the base film after the tray is produced.

6. The method for packaging a product according to claim 2, wherein before bonding the plastic film on the base film, producing a hole in a region of the plastic film that constitutes a part of the rim, after applying the lid film over the cavity and before sealing the lid film to the rim, generating a vacuum between the lid film and the tray through the hole, the hole being closed when the lid film is sealed to the rim.

7. The method for packaging a product according to claim 2, wherein before bonding the plastic film on the base film, producing a hole in a region of the plastic film that constitutes a part of the rim, after applying the lid film over the cavity and before sealing the lid film to the rim, introducing a modified atmosphere into the tray cavity through the hole, the hole being closed when the lid film is sealed to the rim.

8. The method for packaging products according to claim 1, wherein the support cut does not demarcate a closed contour in the forming area of the base film.

9. The method for packaging products according to claim 1, wherein the support cut comprises an X-shape.

10. The method for packaging products according to claim 1, wherein the support cut comprises a Y-shape joined to an inverted Y-shape.

11. A machine for packaging products, the machine comprising:

a pre-cutting tool configured to produce a support cut in a forming area of a base film of a material of a plant or a cellulosic origin;

a forming apparatus that is configured to simultaneously apply pressure and heat on the forming area of the base film and on the forming area of a plastic film disposed over the forming area of the base film, the applied pressure and heat configured to simultaneously cause a bonding of the forming area of the plastic film to the forming area of the base film while at the same time causing a separation of a first region and a second region of the base film located on opposite sides of the support cut to cause a formation of a gap in the forming area of the base film;

the applying of heat and pressure on the forming area of the plastic film forming a tray having a cavity and a rim surrounding the cavity, the formation of the gap in the forming area of the base film resulting in a surface area of the cavity of the tray to be greater than the forming area of the base film.

12. The machine for packaging products according to claim 11, further comprising an apparatus for applying a lid film over the cavity and sealing the lid film to the rim of the tray.

13. The machine for packaging products according to claim 12, further comprising a piercing tool configured to produce a hole in a region of the plastic film that coincides with the support cut in the base film and/or with the gap of the base film.

14. The machine for packaging products according to claim 13, further comprising a vacuum generating apparatus configured to generate a vacuum between the lid film and the tray through the hole.

15. The machine for packaging products according to claim 13, further comprising an apparatus for introducing a gas suitable for packaging products in a modified atmosphere between the lid film and the tray through the hole.

16. The machine for packaging products according to claim 13, wherein the piercing tool is arranged upstream of the second forming apparatus and is configured to produce the hole such that the hole coincides with the gap of the base film after the tray is formed.

17. The machine for packaging products according to claim 11, wherein the pre-cutting tool includes a cutting edge for producing the support cut in the forming area of the base film, the cutting edge being configured so as to not demarcate a closed contour.

18. The machine for packaging products according to claim 11, further comprising an easy-open piercing tool configured to make an easy-open cut in the base film and an easy-open cut in the plastic film, in one and the same region of the rim.

* * * * *